United States Patent [19]

Sidebottom

[11] Patent Number: 4,463,348

[45] Date of Patent: Jul. 31, 1984

[54] REFRIGERATOR DOOR USAGE MONITOR AND DISPLAY SYSTEM

[75] Inventor: Donald L. Sidebottom, Louisville, Ky.

[73] Assignee: General Electric Company, Louisville, Ky.

[21] Appl. No.: 324,305

[22] Filed: Nov. 23, 1981

[51] Int. Cl.[3] ..... G08B 17/00

[52] U.S. Cl. ..... 340/585; 62/125; 62/234; 340/529; 364/144; 364/569; 368/9

[58] Field of Search ..... 62/125, 234; 340/585, 340/529; 364/569, 143, 144; 368/9, 10

[56] References Cited

U.S. PATENT DOCUMENTS

| | | | |
|---|---|---|---|
| 1,852,707 | 4/1932 | Hoffman . | |
| 2,382,733 | 8/1945 | Marcy | 62/4 |
| 2,385,525 | 10/1945 | McCloy . | |
| 2,683,970 | 7/1954 | Jacobs | 62/4 |
| 2,701,450 | 2/1955 | Duncan | 62/4 |
| 2,741,097 | 4/1956 | Miles | 62/4 |
| 2,788,640 | 4/1957 | Newberry | 62/4 |
| 3,055,188 | 9/1962 | Syfert | 62/267 |
| 4,327,557 | 5/1982 | Clarke et al. | 62/234 X |

*Primary Examiner*—David L. Trafton

*Attorney, Agent, or Firm*—Frederick P. Weidner; Radford M. Reams

[57] ABSTRACT

A microcomputer based monitor and display system for a refrigerator in which visual indicia are provided to indicate to the user the degree of door usage on a rolling average time basis. Threshold time limits are established to correspond to heavy, normal and light usage. The actual door-open time is sensed and accumulated in successive time segments. The rolling average door open time over a predetermined number of time segments is calculated at the end of each time segment and the appropriate lamp is lit depending on how the calculated average door-open time compares to the established threshold values.

10 Claims, 4 Drawing Figures

REFRIGERATOR DOOR USAGE MONITOR AND DISPLAY SYSTEM

BACKGROUND OF INVENTION

The present invention relates to a system for monitoring and visually displaying the degree of refrigerator door usage occurring between defrost cycles in a way that enables a user to conserve on refrigerator energy consumption by changing his or her usage habits in terms of the number of times the refrigerator doors are opened and the length of time the doors are held open.

It is known in the prior art to provide systems, primarily electromechanical in nature, that sense when a refrigerator door is opened and that are able to accumulate the amount of time the door is held open. Generally, the systems of this type are used to reduce the amount of time between defrost cycles in a demand defrost system so as to cause the refrigerator to be defrosted more often in response to heavier usage of the refrigerator. It is also known to provide visual indicators for refrigerators such as lamps to indicate, for example, when a defrost cycle is in operation or when a power failure has occurred and also, for example, to indicate when a freezer door has been left slightly ajar inadvertently. However, there is no known system which monitors the number and duration of door openings to provide a visual indication to the user that would enable the user to change his or her usage habits in the direction of conserving energy consumption by the refrigerator.

The number of door openings and the amount of time the door is held open has a direct bearing on the amount of energy usage by the refrigerator both in terms of compressor run time needed to maintain the desired cool temperatures in the refrigerator and of the timing of defrost cycles needed to remove frost from the evaporator coils in the refrigerator. Consequently, the door usage monitor of this invention has utility in refrigerators to reduce energy consumption generally by enabling the user indirectly to control the compressor run time needed to maintain cool temperatures in the refrigerator. Since the defrost cycle in an automatic defrost refrigerator represents a major element of energy usage, the invention has particular utility in a demand defrost usage refrigerator in which the timing of defrost cycles is determined by the number of door openings and/or the amount of actual door open time. In demand defrost refrigerator systems, if there are no door openings, the time interval between defrost cycles is at a maximum and the minimum amount of energy for defrosting will be used over an extended time period. As the doors are opened periodically, the defrost cycle time interval is reduced as determined by the demand defrost system until a minimum time interval between defrosts is reached thus using a maximum amount of energy for defrosting on an ongoing basis. Consequently, it can be seen that a door usage monitor system can be effective in reducing refrigerator energy usage by encouraging decreased door usage in order to reduce compressor run time and also, in a demand defrost refrigerator, to stretch out the interval between defrost cycles.

SUMMARY OF INVENTION

Therefore, in accordance with the invention, there is provided a refrigerator door usage monitor and display system which comprises clock means and means for sensing when a refrigerator door is open. The system of the invention also includes a microcomputer having accumulator means responsive to the door-open sensing means and to the clock means for accumulating a count representative of the amount of door-open time occurring in each of a plurality of successive time segments, where, for example, the time segments might be of fifteen minutes duration each. The microcomputer also includes arithmetic means responsive to the accumulator means for periodically calculating and providing an output signal representative of the rolling average door-open time for a predetermined number of the successive time segments. This rolling average door-open time in one form of the invention can be calculated on the basis of the total aggregate door-open time over the total number of time segments with the time being recalculated and updated at the conclusion of each time segment or, alternatively, the door-open time can be calculated as the amount of door-open time per time segment with updating occurring at the conclusion of each time segment.

The system of the invention further includes display means responsive to the output signal of the microcomputer for providing visual indicia to indicate when the rolling average door-open time is greater than a predetermined normal range of rolling average door-open times. The display means optionally may also provide indicia to indicate when the rolling average door-open time is less than the normal range and still further indicia to indicate when it is within the normal time range.

In one preferred form of the invention, a duration of fifteen minutes is established for each time segment. Longer time segment durations, e.g. 30 minutes, could be employed although this would not provide as fast a reaction of the display to short term changes in door usage patterns as would the use of shorter time segment durations. The number of time segments used as a base in calculating the rolling average door-open time is preferably selected in accordance with the refrigerator design. In a refrigerator having a maximum time interval between defrost cycles of six hours, a three hour base equivalent to twelve time segments of fifteen minutes each may be considered appropriate although it will be appreciated that other time bases may be used. With a refrigerator of the type having separate fresh food and freezer compartment doors, separate sensors are included for each door and the accumulated time for the freezer door-open time is assigned an increased time weighting factor relative to the fresh food door in calculating the rolling average door-open time in order to allow for the greater effect on energy usage caused by freezer door openings. The weighting factor applied to the freezer door-open time is dependent on the refrigerator design but typically can be anywhere from, for example, as low as 1.2 times to 3.0 times the fresh food door-open time.

DETAILED DESCRIPTION

Figure 1:
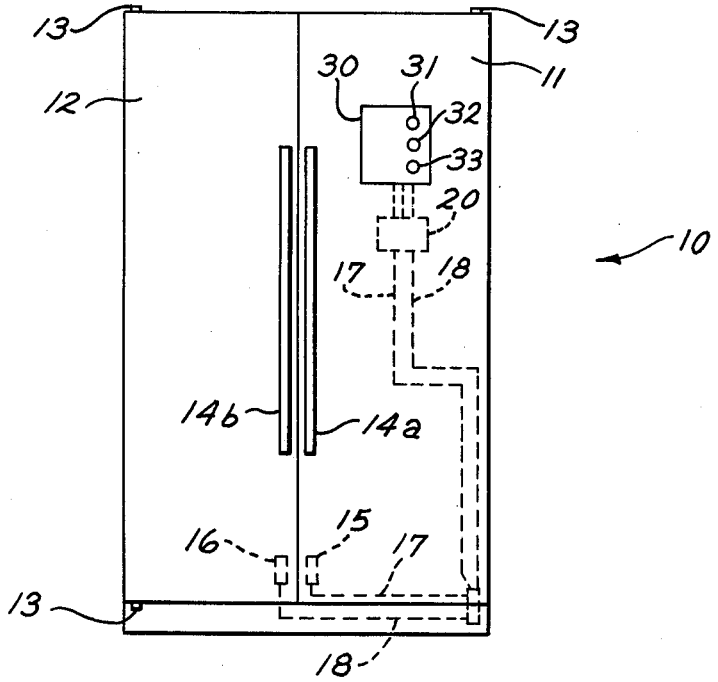
FIG. 1 is a diagrammatic illustration of a two-door refrigerator embodying the present invention.
Figure 2:
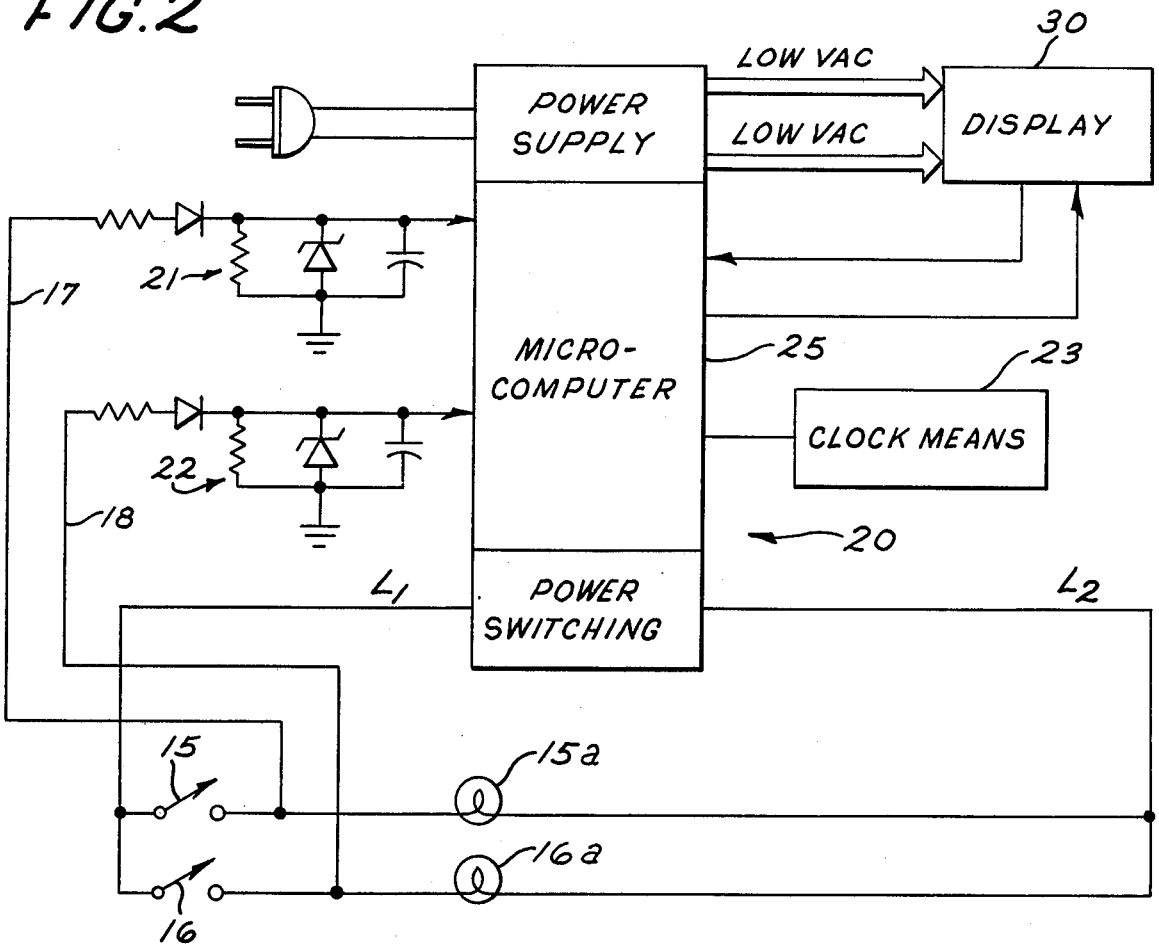
FIG. 2 is a circuit diagram partly schematic and partly in block form of a control circuit useful in performing the functions of the present invention.

Referring jointly to FIGS. 1 and 2, a refrigerator door usage monitoring and display system is shown embodied in a side-by-side two-door refrigerator 10 having a fresh food door 11 and a freezer door 12 mounted on hinges 13 and provided with handles 14*a*, 14*b* to furnish access to the interior fresh food and freezer compartments upon opening of the doors 11 and 12, respectively. Means for sensing when either or both of doors 11, 12 are open includes sensor switches 15 and 16 which may comprise conventional push button or rocker switches or reed switches mounted either on the face panels of the refrigerator mullions or directly on the doors.

Electronic control unit 20 is preferably mounted within the interior of one of the doors 11, 12, in this case the fresh food door. Control unit 20 includes clock means 23 and also includes a microcomputer 25 which may be of any well known configuration currently available with the exception of the preprogrammed portion thereof in accordance with the present invention. Clock means 23 may be a separate electronic timing circuit or, more preferably, it may be the internal clocking means conventionally included in the microcomputer. Microcomputer 25 includes accumulating means such as analog to digital converter input circuits and suitable memory registers responsive to the sensing switches 15, 16 and to clock means 23 for accumulating a count representative of the amount of door-open time for the doors 11, 12 in each of a plurality of successive time segments, the time segments preferably comprising fixed time intervals of, for example, 15 minutes each. When either of doors 11 or 12 is opened, the corresponding normally open sensor switch 15 or 16 is closed causing optional door indicator lamps 15*a* or 16*a* to be lit and causing a signal to be communicated via lines 17 or 18 through pulse forming circuit 21 or 22 to analog to digital converter input circuits included in microcomputer 25. As is well known in the art, microcomputer 25 includes a central processing unit, input/output circuits and various digital storage media operated under the control of an internal programming unit or programmable read-only memory (PROM) to perform designated functions and calculations. In one form of the invention, a count value generated by the A/D circuit which is representative of the duration of a door-open condition is caused to be stored in a read/write memory as the PROM conditions the memory of the microcomputer 25 to be responsive to the sensor switches 15, 16.

Microcomputer 25 further comprises arithmetic means in the central processing unit which is operative under appropriate instructions from the PROM to be responsive to the output of the accumulator means to periodically calculate the rolling average door-open time for a predetermined number of the time segments. For example, twelve time segments of fifteen minutes duration for each segment would provide a time base of three hours for determining the rolling average door-open time. As will be seen, the average door-open time may be calculated over the three hour time base by accumulating the weighted door-open time and updating the time at the conclusion of each fifteen minute time segment. Alternatively, it may be accumulated and calculated as the amount of door-open time per time segment, the updating also occurring at the conclusion of each fifteen minute time segment. The actually selected time frames and repetition rate at which the average door-open time is recalculated is a matter of choice and any suitable parameters for this purpose may be employed.

The calculated rolling average door-open time is then stored and is used to generate an output signal from microcomputer 25 which is supplied to display means 30. Indicator lamps 31, 32, 33 are provided in display means 30 to serve as indicia operated in response to the output signal from microcomputer 25 to indicate at least when the rolling average door-open time is in excess of the normal range of door-open times. Thus indicator lamp 31 with a suitable marking such as "Heavy" may be a red indicator lamp which, when lit, would indicate unusually heavy usage of the refrigerator encouraging the user to reduce, for example, the amount of time a door is held open. For a more complete display, an indicator lamp 32, marked "Normal" and colored green, for example, may be provided to indicate normal level of usage while indicator lamp 33, marked "Light" and colored orange, for example, may be provided to indicate a low amount of usage.

From data based on actual usage tests, the amount of time the refrigerator door or doors are open under heavy usage condition can be specified on a somewhat empirical basis. In one such heavy usage test (H.U.T.), it was determined that over a period of six hours, the fresh food door would be opened 45 times for an average open time of 12 seconds per use. Moreover, it can be shown that in the case of a two door refrigerator freezer, opening of the freezer door has a disproportionate effect on compressor run time which can be expressed in terms of a multiplier or weighting factor applied to equivalent fresh food door-open time. Although the actual weighting factor depends on the specific refrigerator design, it has been found that factors of 1.2 to 3.0 are fairly representative of commercially available refrigerators. Moreover, for the two door refrigerator freezer, the heavy usage test indicates that the freezer door would be opened one-fourth as many times (11.25) as the fresh food door for the same average open time of 12 seconds per use. With these results, the equivalent heavy usage door-open time (H.U.T.) can be specified as:

$$H.U.T. = 45 \times 12 + 45/4 \times 12 \times 1.2 = 702 \text{ secs.}$$

For a three hour time base, the corresponding value of accumulated door-open time would be one-half this time or 351 seconds. Assuming this time base is broken into time segments of 15 minutes duration each, this rolling average door-open time per time segment would then be 351/12 or 29.25 seconds per time segment. In accordance with a feature of the invention, the actual door usage time can be characterized as being "heavy" usage if it exceeds $\frac{3}{4}$ H.U.T. and "light" usage if it is less than $\frac{1}{4}$ H.U.T., with door usage times of $\frac{1}{4}$ H.U.T. through $\frac{3}{4}$ H.U.T. being considered in the "normal" range of door usage. For the H.U.T. time factors given above, the range of "normal" door usage times for a three hour time base would then be 87.75 seconds to 263.25 seconds, and the corresponding range of the "normal" rolling average time per time segment would be from 14.625 secs/segment to 43.875 secs/segment.

Figure 4:
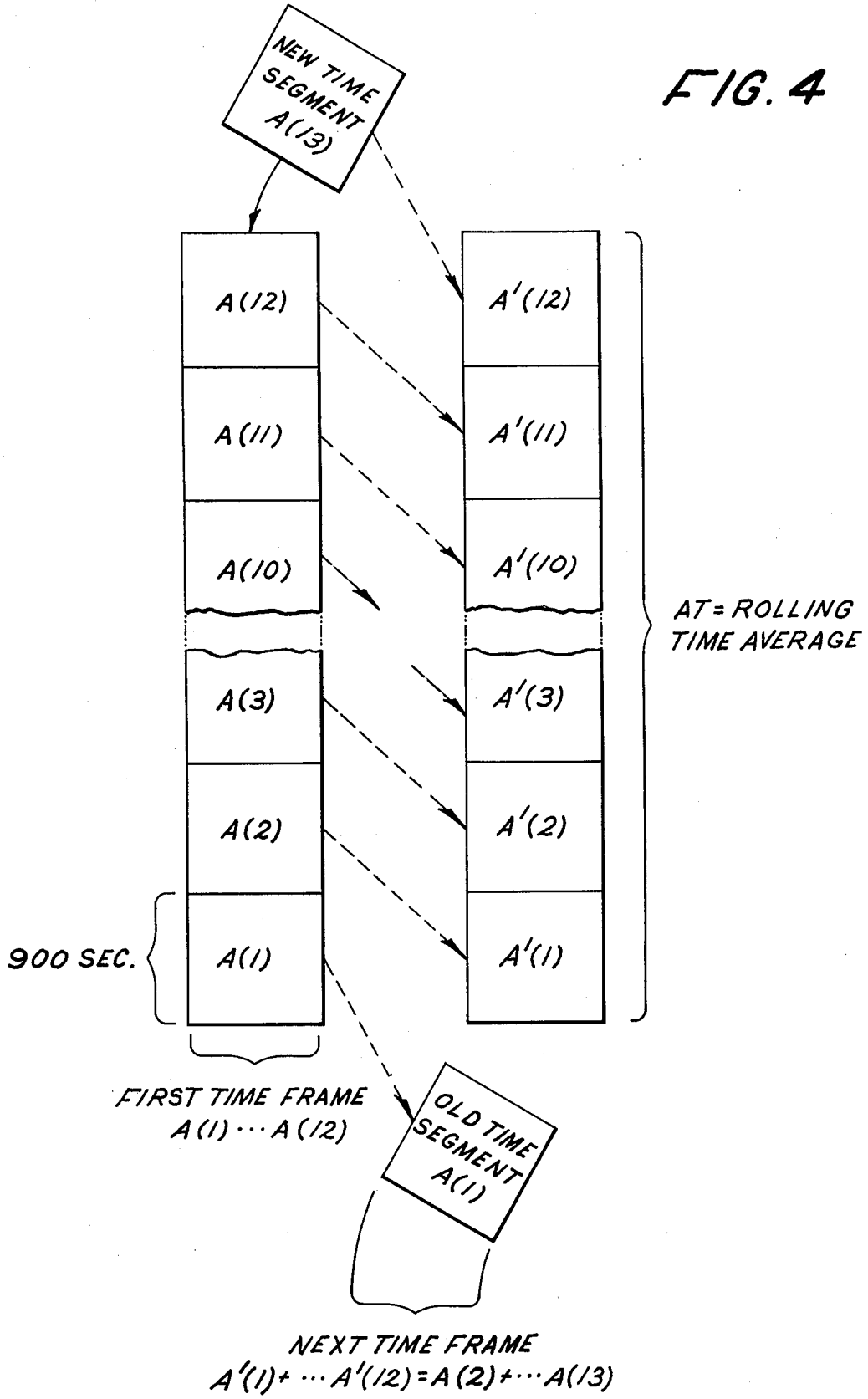
FIG. 4 is a chart useful in explaining the concept of the present invention.

Having established the desired time values representing thresholds delineating heavy and light usage, microcomputer 25 can be programmed to accumulate the amount of door-open time occurring during each fifteen minute time segment to periodically calculate, i.e. at the conclusion of each time segment, the rolling average door-open time over the predetermined number of, for example, twelve time segments. For example, this may be done by accumulating the door-open time in seconds per time segment and, at the conclusion of the thirteenth time segment, discarding the door-open time from the oldest time segment and adding the door-open time from the newest (13th) time segment, thus giving an updated door-open time for the most recent twelve time segments. If the calculated value exceeds the exemplary threshold value of 263.25 seconds, the heavy usage indicator lamp 31 is illuminated; and if it is lower than the exemplary threshold value of 87.75 seconds, the light usage indicator lamp 33 is illuminated. Any value in between would cause the normal usage lamp 32 to be illuminated. Alternatively, as previously mentioned, microcomputer 25 can calculate the average door-open time per time segment by dividing the accumulated time at the end of each time segment by twelve. In the initial time period after power is newly applied to the refrigerator, the average times for the actual number of time segments incurred since power on can be calculated until the predetermined number of time segments is reached, or alternatively the time values may be added to zeros for the deficient time segments until the predetermined number of time segments is reached. In the latter case, the light or normal usage lamps would be lit during the initial number of time segments and the heavy usage lamp could probably not be illuminated until the predetermined number of time segments is reached; that is, until the first three hours has expired. After that, the rolling average calculation would give a true indication of door usage. In FIG. 4, the manner in which the rolling average time is calculated is graphically illustrated for the exemplary situation using twelve time segments of fifteen minutes each. As previously stated, other combinations of number of time segments and duration of time segments may be used.

Figure 3:
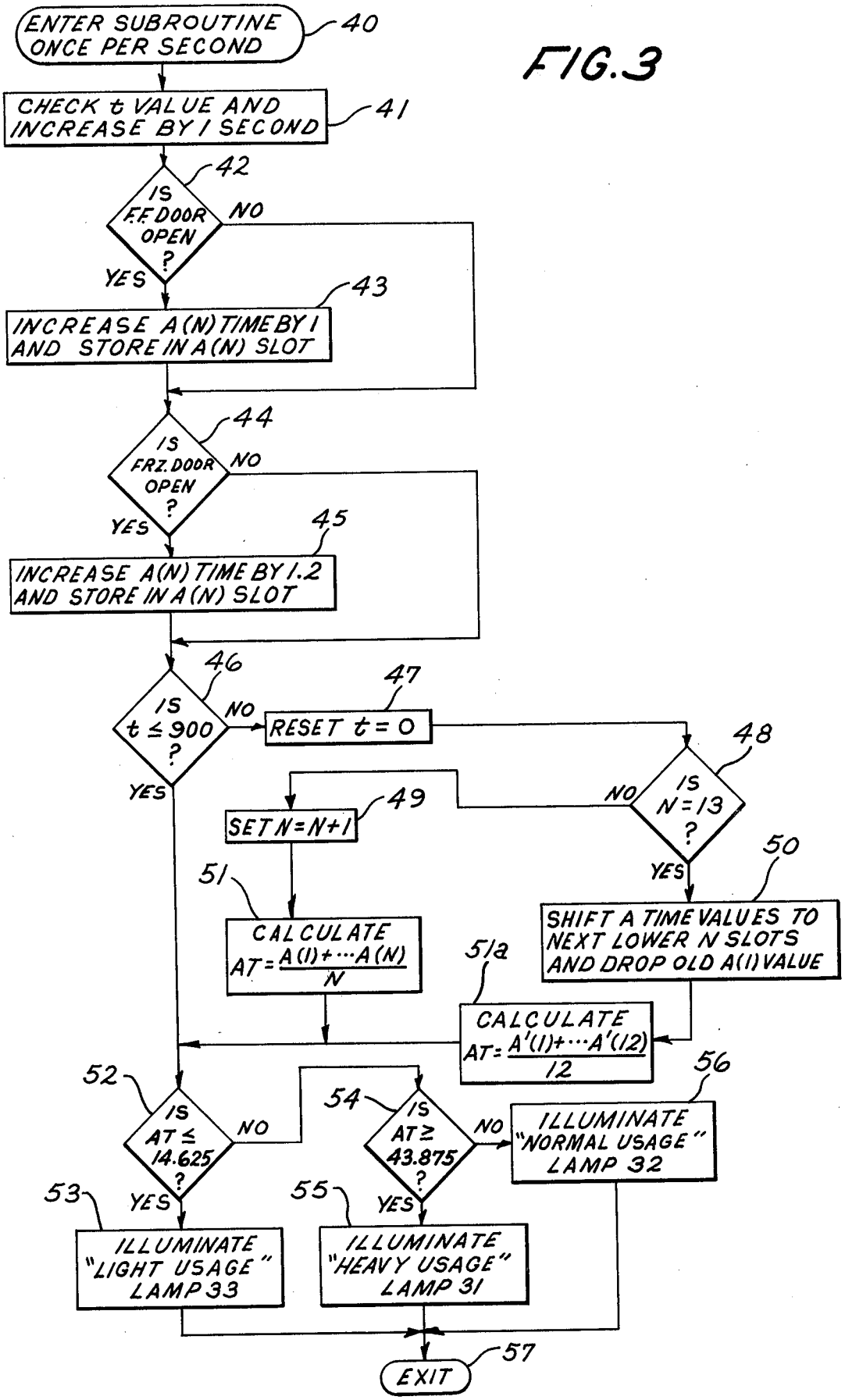
FIG. 3 is a flow diagram illustrating the manner in which microcomputer may be programmed to perform the present invention.

Referring to FIG. 3, a functional program flow diagram is shown to illustrate one preferred manner in which a microcomputer 25 can be programmed, using well known programming techniques, to operate in accordance with the novel teachings of the invention. Thus, upon entering the subroutine at 40 once each second, the first instruction 41 is to check the real time value t of the time segment and to increase the value by one. Following this, enquiry 42 determines from the condition of door switch 15 whether the fresh food door 11 is open. If the door 11 is closed, instruction 43 is bypassed but, if open, instruction 43 causes the accumulated value of door-open time to be increased by one second. In a similar manner, enquiry 44 determines from the condition of door switch 16 whether the freezer door is open. Assuming it is, the accumulated door-open time is increased by instruction 45 by a weighted time value, in this case 1.2 seconds although as previously noted, other weighting factors can be employed.

After this, enquiry 46 determines whether the time segment limit, i.e. fifteen minutes or 900 seconds has been exceeded. Assuming that it has, which would be the case the next time through the subroutine after the 900 second limit was reached, instruction 47 resets the time segment value to 0. Enquiry 48 then determines whether thirteen time segments have transpired and, if not, (as in the case where power was recently applied to the refrigerator) instruction 49 increases the time segment value N by one. If N is the predetermined number 13, instruction 50 causes the accumulated time values for each of the time segments 1–13 to be shifted so as to drop off the oldest time segment value A(1) and replacing it with the next time segment value A(2) thus creating a new sequence of time values A'(1) through A'(12). In this notation, the number in the parenthesis indicates the sequential time segment ranking and the letter A represents the accumulated door-open time for that particular time segment. After the conclusion of either instruction 49 or 50, instruction 51 or 51*a*, respectively, causes the arithmetic unit to calculate the rolling average door-open time value AT (on a per segment basis in this example) for the predetermined number of time segments. It will be appreciated that instruction 51 enables the display to indicate the time value AT beginning with the first time segment following application of power to the refrigerator by selecting the proper value for N depending on how long it has been since power-up. Enquiry 52 then determines if the calculated value AT is below the lower limit of the normal range of rolling average time values and, if so, instruction 53 causes the LIGHT usage lamp 33 to be lit. If not, enquiry 54 determines if the value exceeds the upper limit of the normal range, an affirmative answer resulting in instruction 55 causing HEAVY usage lamp 31 to be lit while a negative answer results in instruction 56 causing NORMAL lamp 32 to be lit. After the appropriate lamp has been lit, the subroutine exits to the main program at exit 57. Reverting to enquiry 46, if the result had been that the 900 second real time value had not yet been reached, the program would move directly to enquiry 52 with the result that either the LIGHT usuage lamp would be lit (if this were the first time segment after power-up) or the existing condition of the lamps 31–33 would remain unchanged in accordance with the results of the calculation of AT that occurred in the immediately preceding time segment (N−1).

It will be appreciated that there has been described a convenient and useful means whereby a refrigerator user can be provided with a visual reminder of his or her usage habits from which the user can vary the usage habits, as needed, to conserve on energy usage. While there has been described what, at present, is believed to be preferred embodiments of the invention, it will be obvious to those skilled in the art that various changes and modifications may be made therein without departing from the invention. It is, therefore, intended by the appended claims to cover all such changes and modifications as fall within the true spirit and scope of this invention.

What is claimed is:

1. Refrigerator door usage monitor and display system comprising:

clock means;

means for sensing when a refrigerator door is open;

a microcomputer including accumulator means responsive to the door-open sensing means and to the clock means for accumulating a count representative of the amount of door-open time occurring in each of a plurality of successive time segments, and arithmetic means responsive to the accumulator means for periodically calculating and providing an output signal representative of the rolling average door-open time for a predetermined number of said successive time segments;

and display means responsive to said microcomputer output signal for providing visual indicia to indicate when the rolling average door-open time is greater than a predetermined normal range of rolling average door-open times.

2. The system of claim 1 in which said display means includes means for providing visual indicia to indicate when the rolling average door-open time is less than said normal range of times.

3. The system of claims 1 or 2 in which said display means includes means for providing visual indicia of when the rolling average door-open time is within said normal range of times.

4. The system of claim 1 adapted for use with a refrigerator having a fresh food compartment door and a freezer compartment door in which the sensing means includes separate door sensors for the fresh food and freezer doors, respectively; in which the accumulator means accumulates the door-open time for both of said doors; and in which the arithmetic means calculates the combined rolling average door-open time for both of said doors.

5. The system of claim 4 in which an increased time weighting factor is assigned to the door-open time for the freezer door over that assigned to the fresh food door to compensate, at least partially, for the greater effect on energy usage by the refrigerator resulting from the freezer door opening relative to that resulting from the fresh food door opening.

6. The system of claim 5 in which said freezer door time weighting factor is at least 1.2 times that assigned to the fresh food door.

7. The system of claim 1 in which the arithmetic means is adapted to recalculate the rolling average door-open time at the conclusion of each of said time segments.

8. The system of claim 1 or 5 in which the arithmetic means is adapted to recalculate the rolling average door-open time at the end of each of said time segments for the total number of time segments occurring after power is initially applied to the refrigerator until said predetermined number of time segments is reached and thereafter for the predetermined number of immediately preceding time segments.

9. Refrigerator door usage monitor and display system for a refrigerator having a fresh food compartment door and a freezer compartment door, the system comprising:

clock means;

means including a separate door-open sensor for the fresh food and freezer doors, respectively, for sensing when each door is open;

a microcomputer including accumulator means responsive to the sensing means and the clock means for accumulating a count representative of the amount of time the doors are open during each of a plurality of successive time segments, A(N), the time segments A(N) each having equal, fixed, real-time durations, and arithmetic means for calculating the combined weighted rolling average door-open time, AT, of said doors for a predetermined number of successive time segments A(N), the rolling average door-open time AT being recalculated at the end of each time segment A(N) and the door-open time of the freezer door being assigned a time weighting factor of at least about 1.2 times that assigned to the fresh food door to compensate, at least partially, for the greater effect on energy usage resulting from the freezer door opening relative to that resulting from the fresh food door opening;

and display means responsive to said microcomputer means for visually indicating by separate indicia (a) the existence of a rolling average door-open time AT exceeding a first predetermined threshold time value representative of heavy door usage and (b) the existence of a rolling average door-open time AT less than a second threshold time value shorter in duration than said first threshold value and representing light door usage.

10. The system of claim 9 in which the duration of time segments A(N) is approximately fifteen minutes each.

* * * * *